US007951050B2

(12) United States Patent
Raumann et al.

(10) Patent No.: US 7,951,050 B2
(45) Date of Patent: May 31, 2011

(54) APPARATUS FOR AEROBIC LEG EXERCISE OF A SEATED USER

(76) Inventors: Kelvin A. Raumann, Henderson, NV (US); Wanda L. Raumann, Las Vegas, NV (US)

( * ) Notice: Subject to any disclaimer, the term of this patent is extended or adjusted under 35 U.S.C. 154(b) by 0 days.

(21) Appl. No.: 12/497,648

(22) Filed: Jul. 4, 2009

(65) Prior Publication Data

US 2011/0003666 A1 Jan. 6, 2011

(51) Int. Cl.
*A63B 23/08* (2006.01)
*A63B 22/00* (2006.01)

(52) U.S. Cl. ..... 482/79; 482/51

(58) Field of Classification Search ..... 482/51, 482/79–80, 70–71
See application file for complete search history.

(56) References Cited

U.S. PATENT DOCUMENTS 4,402,506 A * 9/1983 Jones ..... 482/70
4,781,372 A * 11/1988 McCormack ..... 482/70
5,279,530 A * 1/1994 Hess ..... 482/70
5,304,106 A * 4/1994 Gresko ..... 482/53
5,520,598 A * 5/1996 Little ..... 482/79
5,855,538 A * 1/1999 Argabright ..... 482/70
6,837,838 B2 * 1/2005 List ..... 482/147
D623,244 S * 9/2010 Hoffman ..... D21/668
2001/0036885 A1 * 11/2001 Castellot et al. ..... 482/79
2009/0098983 A1 * 4/2009 Hoffman ..... 482/70

* cited by examiner

*Primary Examiner* — Fenn C Mathew
(74) *Attorney, Agent, or Firm* — Ariel S. Bentolila; Bay Area IP Group, LLC

(57) ABSTRACT

An apparatus for aerobic leg exercise of a seated user includes a first unit having means for supporting a first linear track on a floor, means for joining a first unit to the first linear track for non-resistive movement and means for enabling the seated user with a multi-positional contact for moving the first unit along the first linear track without substantial vertical movement of the seated user's knee. A second unit has means for supporting a second linear track on the floor, means for joining a second unit to the second linear track for non-resistive movement and means for enabling the seated user with a multi-positional contact for moving the second unit along the second linear track without substantial vertical movement of the seated user's knee. A means secures the first unit and the second unit at a desired splay angle and a means stabilizes the apparatus.

10 Claims, 3 Drawing Sheets

APPARATUS FOR AEROBIC LEG EXERCISE OF A SEATED USER

FEDERALLY SPONSORED RESEARCH OR DEVELOPMENT

Not applicable.

REFERENCE TO SEQUENCE LISTING, A TABLE, OR A COMPUTER LISTING APPENDIX

Not applicable.

COPYRIGHT NOTICE

A portion of the disclosure of this patent document contains material that is subject to copyright protection. The copyright owner has no objection to the facsimile reproduction by anyone of the patent document or patent disclosure as it appears in the Patent and Trademark Office, patent file or records, but otherwise reserves all copyright rights whatsoever.

FIELD OF THE INVENTION

The present invention relates generally to exercise equipment. More particularly, the invention relates to an exercise device for placement on the floor that can be easily operated by a seated user.

BACKGROUND OF THE INVENTION

Far too many Americans spend the majority of their time sitting at a desk, getting more out of shape and a good bit heavier in the process. Even though it is clear that Americans want to exercise, too many lack the opportunity. The problem is not that they do not want to exercise; after all, over 35 million Americans belong to a health club or gym. The problem is typically that they lack the time to regularly go to these gyms because of their jobs. Sitting behind a desk from 9-to-5 is bad enough, and the health results from sitting all day is even worse, but when an individual's work requires their hours to extend so much that it takes away from exercise opportunities, that is worse. It is therefore an objective of the present invention to provide an exercise device that enables users to exercise while seated so that they can exercise while performing their work obligations.

For years, unique and innovative health and personal care items and related products have been an interest and potential need of wide segments of individuals including, but not limited to, users, manufacturers, suppliers, and retailers. Included among these individuals are the sporting and athletic goods industry and private individuals. However, while products designed to provide similar functions are currently available, there are no devices that incorporate the convenience, unique design, functionality, and methodology of preferred embodiments of the present invention.

While practically all Americans brag about participating in some sort of sporting activity, very few uphold to one athletic exercise in particular except when it comes to actual physical fitness exercise with exercise equipment. More than one out of every six Americans practices exercising with equipment, making this the fourth most popular sporting activity in the United States. Sales of exercise equipment are growing, too. Over 20 percent of the sales of the entire sporting goods industry are for exercise equipment, in fact. What exactly do Americans want from their exercise, and to what parts of their bodies? Americans that regularly practice physical exercise desire a toning of the muscles in the lower half of the body most. They exercise their legs with regularity, not just to control weight, but also to maintain a desired appearance. Many Americans want to exercise their lower bodies, and a very large number have need to do so for everyday exercise and for established medical needs. In fact, every year 11 million Americans consult their doctors for pain in their ankles and feet, and 19 million do so for knee problems. And each of these problems can be addressed with regular exercise, especially one of a therapeutic, non-impact, aerobic format. It is therefore an objective of the present invention to provide an exercise device that exercises the legs that is preferably non-impact and aerobic.

In view of the foregoing, there is a need for improved techniques for providing an exercise device that enables users to perform non-impact and aerobic exercise of the lower body while seated.

BRIEF DESCRIPTION OF THE DRAWINGS

The present invention is illustrated by way of example, and not by way of limitation, in the figures of the accompanying drawings and in which like reference numerals refer to similar elements and in which:

FIG. 1A is a diagrammatic top view. FIG. 1B is a diagrammatic top view of the exercise device in a disassembled state. FIG. 1C is a top and bottom diagrammatic view of padded units of the exercise device, and FIG. 1D is a diagrammatic side view of the exercise device in use;

Figure 1A:
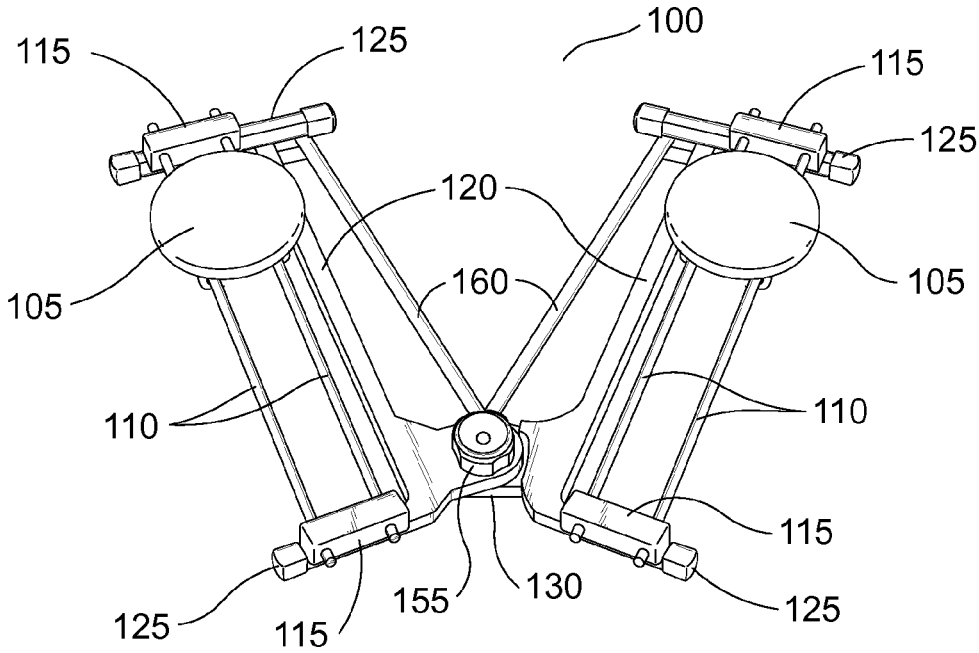
FIGS. 1A, 1B, 1C, and 1D illustrate an exemplary exercise device, in accordance with an embodiment of the present invention.

Unless otherwise indicated illustrations in the figures are not necessarily drawn to scale.

SUMMARY OF THE INVENTION

To achieve the forgoing and other objects and in accordance with the purpose of the invention, an apparatus for aerobic leg exercise of a seated user is presented.

In one embodiment an apparatus for aerobic leg exercise of a seated user is presented. The apparatus includes a first unit including means for supporting a first linear track on a floor, means for joining a first unit to the first linear track for non-resistive movement and means for enabling the seated user with a multi-positional contact for moving the first unit along the first linear track without substantial vertical movement of the seated user's knee. Another embodiment further includes a second unit including means for supporting a second linear track on the floor, means for joining a second unit to the second linear track for non-resistive movement and means for enabling the seated user with a multi-positional contact for moving the second unit along the second linear track without substantial vertical movement of the seated user's knee. Still another embodiment further includes means for contacting the floor surface. Yet other embodiments further include means for securing the first unit and the second unit at a desired splay angle and means for stabilizing the first unit and the second unit. Another embodiment further includes means for massaging and stimulation. In still another embodiment dimensions of the apparatus are suitable for placing in an opening under a desk.

In another embodiment an apparatus for aerobic leg exercise of a seated user is presented. The apparatus includes a first unit including a first I-bar frame including a first bar, extending arms at each distal end of the first bar and a first roundhead arm extending from a first side of the first bar proximate a first distal end of the first bar. The first roundhead arm has a rounded portion at a distal end with an aperture disposed in the rounded portion. End brackets are joined to tops of each extending arm. A first linear track is joined to and disposed between the end brackets. A first padded unit is slidably joined to the first linear track for non-resistive movement between the end brackets. The first padded unit has a generally domed shaped top for enabling the seated user with a multi-positional contact for moving the first padded unit along the first linear track without substantial vertical movement of the seated user's knee. Another embodiment further includes a second unit including a second I-bar frame including a second bar having a first side generally facing the first roundhead arm, extending arms at each distal end of the second bar and a second roundhead arm extending from the first side of the second bar proximate a first distal end of the second bar. The roundhead arm has a rounded portion at a distal end with a bolt, dimensioned to fit in the aperture, disposed in the rounded portion. End brackets are joined to tops of each extending arm. A second linear track is joined to and disposed between the end brackets. A second padded unit is slidably joined to the second linear track for non-resistive movement between the end brackets. The second padded unit has a generally domed shaped top for enabling the seated user with a multi-positional contact for moving the second padded unit along the second linear track without substantial vertical movement of the seated user's knee. In still another embodiment the first linear track and the second linear track each includes at least two linear rods. Yet another embodiment further includes a plurality of feet joined to bottoms of the extending arms of the first I-bar frame and the second I-bar frame for contacting a floor surface. Another embodiment further includes a threaded attachment cap for securing the first unit and the second unit at a desired splay angle where the bolt is inserted in the aperture and the threaded attachment cap is tightened on the bolt. Still another embodiment further includes a stabilizer bar including two linear portions rotatably joined at distal ends, the stabilizer bar rotatably joinable to the first I-bar frame and the second I-bar frame. In yet another embodiment dimensions of the apparatus are suitable for placing in an opening under a desk. Another embodiment further includes a plurality of free-rotating discs for massaging and stimulation. In still another embodiment the first padded unit and the second padded unit include vinyl covered foam.

In another embodiment an apparatus for aerobic leg exercise of a seated user is presented. The apparatus includes a first unit including a first I-bar frame disposed in a first plane. The first I-bar frame includes a first bar, extending arms disposed in the first plane at each distal end of the first bar and a first roundhead arm extending along the first plane from a first side of the first bar proximate a first distal end of the first bar. The first roundhead arm has a rounded portion at a distal end with an aperture disposed in the rounded portion. A plurality of feet are joined to bottoms of the extending arms for contacting a floor surface. End brackets are joined to tops of each extending arm portion extending from a second side of the first bar. A first linear track is joined to and disposed between the end brackets. The first linear track includes at least two linear rods. A first padded unit is slidably joined to the first linear track for non-resistive movement between the end brackets. The first padded unit has a generally domed shaped top for enabling the seated user with a multi-positional contact for moving the first padded unit along the first linear track without substantial vertical movement of the seated user's knee. A second unit includes a second I-bar frame disposed in the first plane. The second I-bar frame including a second bar having a first side generally facing the first roundhead arm, extending arms disposed in the first plane at each distal end of the second bar and a second roundhead arm extending along the first plane from the first side of the second bar proximate a first distal end of the second bar. The roundhead arm has a rounded portion at a distal end with a bolt, dimensioned to fit in the aperture, disposed in the rounded portion. A plurality of feet are joined to bottoms of the extending arms for contacting the floor surface. End brackets are joined to tops of each extending arm. A second linear track is joined to and disposed between the end brackets. The second linear track includes at least two linear rods. A second padded unit is slidably joined to the second linear track for non-resistive movement between the end brackets. The second padded unit has a generally domed shaped top for enabling the seated user with a multi-positional contact for moving the second padded unit along the second linear track without substantial vertical movement of the seated user's knee. A threaded attachment cap secures the first unit and the second unit at a desired splay angle where the bolt is inserted in the aperture and the threaded attachment cap is tightened on the bolt. A stabilizer bar includes two linear portions rotatably joined at distal ends. The stabilizer bar is rotatably joinable to the first I-bar frame and the second I-bar frame. In another embodiment dimensions of the apparatus are suitable for placing in an opening under a desk. Still another embodiment further includes a plurality of free-rotating discs for massaging and stimulation. In yet another embodiment the first padded unit and the second padded unit include vinyl covered foam.

Other features, advantages, and object of the present invention will become more apparent and be more readily understood from the following detailed description, which should be read in conjunction with the accompanying drawings.

DETAILED DESCRIPTION OF THE PREFERRED EMBODIMENTS

The present invention is best understood by reference to the detailed figures and description set forth herein.

Embodiments of the invention are discussed below with reference to the Figures. However, those skilled in the art will readily appreciate that the detailed description given herein with respect to these figures is for explanatory purposes as the invention extends beyond these limited embodiments. For example, it should be appreciated that those skilled in the art will, in light of the teachings of the present invention, recognize a multiplicity of alternate and suitable approaches, depending upon the needs of the particular application, to implement the functionality of any given detail described herein, beyond the particular implementation choices in the following embodiments described and shown. That is, there are numerous modifications and variations of the invention that are too numerous to be listed but that all fit within the scope of the invention. Also, singular words should be read as plural and vice versa and masculine as feminine and vice versa, where appropriate, and alternative embodiments do not necessarily imply that the two are mutually exclusive.

The present invention will now be described in detail with reference to embodiments thereof as illustrated in the accompanying drawings.

Detailed descriptions of the preferred embodiments are provided herein. It is to be understood, however, that the present invention may be embodied in various forms. Therefore, specific details disclosed herein are not to be interpreted as limiting, but rather as a basis for the claims and as a representative basis for teaching one skilled in the art to employ the present invention in virtually any appropriately detailed system, structure or manner.

It is to be understood that any exact measurements/dimensions or particular construction materials indicated herein are solely provided as examples of suitable configurations and are not intended to be limiting in any way. Depending on the needs of the particular application, those skilled in the art will readily recognize, in light of the following teachings, a multiplicity of suitable alternative implementation details.

Preferred embodiments of the present invention provide an exercise device for placement on the floor that a user can easily operate while seated in front of it. Preferred embodiments feature padded units that can be pushed by the feet to slide upon linear tracks. In typical use of the preferred embodiment, a user simply applies his feet upon the padded units and slides the units back and forth.

The exercises for which preferred embodiments of the present invention can be used are aerobic and non-resistant, meaning the user does not have to break out in a sweat after short and simple use. Preferred embodiments are also quietly operated. The compact size of preferred embodiments enables these devices to easily fit under a work desk. These qualities enable preferred embodiments to fit within a workspace, to be used within this workspace, and to not put users in any condition that would make them sweaty or in any other way unfit for their workspace. Preferred embodiments also enable therapeutic physical exercises to be done in a format that is convenient to those of recognized need for such exercise and convenience. Furthermore, preferred embodiments require no lubrication or other maintenance services.

Figure 1B:
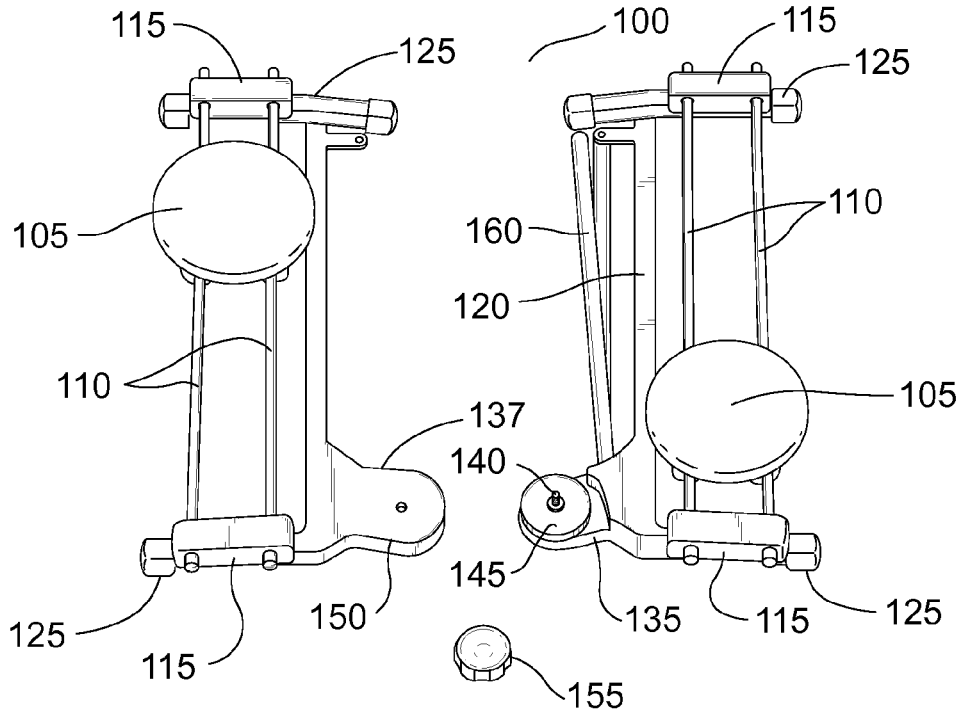
Figure 1C:
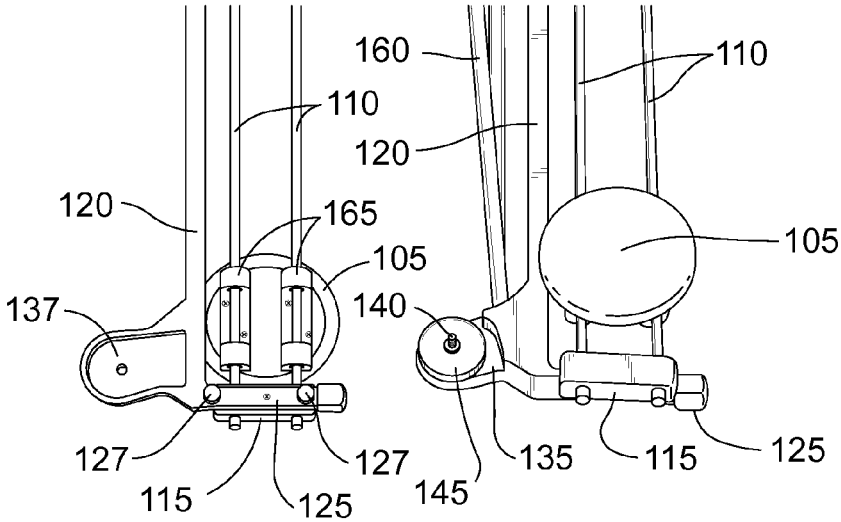
Figure 1D:
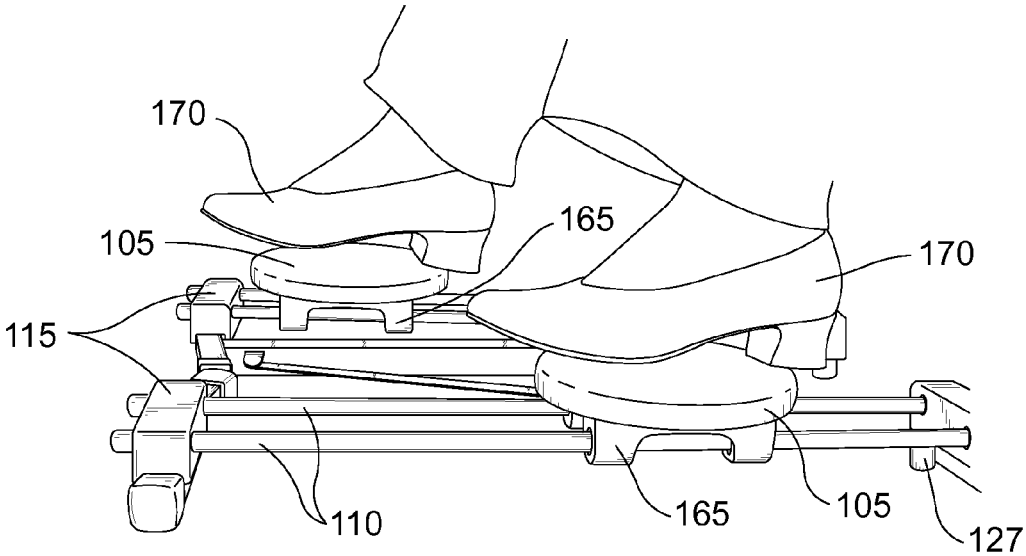

FIGS. 1A, 1B, 1C, and 1D illustrate an exemplary exercise device 100, in accordance with an embodiment of the present invention. FIG. 1A is a diagrammatic top view. FIG. 1B is a diagrammatic top view of exercise device 100 in a disassembled state. FIG. 1C is a top and bottom diagrammatic view of padded units 105 of exercise device 100, and FIG. 1D is a diagrammatic side view of exercise device 100 in use. In the present embodiment, exercise device 100 provides means for aerobic and repetitive motion exercises of the lower limbs to be conducted while sitting. Exercise device 100 comprises padded units 105 that slide upon linear tracks 110 and can be positioned upon a floor in any location. Exercise device 100 comprises two separate units of linear tracks 110. Linear tracks 110 are preferably made of durable high-density polyethylene (HDPE) tubing that is approximately twenty-four inches in length and one half-inch diameter (24"×½"). These units of tubing are in parallel alignment to each other with an approximate five-inch (5") separating distance. Those skilled in the art, in light of the present teachings will readily recognize that the liner tracks in alternate embodiments may be made of various different materials such as, but not limited to, various metals or other types of plastic and may be various different sizes and widths. In the present embodiment, the ends of the aligned tubing units of linear tracks 110 are enclosed within brackets 115 which are preferably made of HDPE; however the brackets in alternate embodiments may be made of various different materials such as, but not limited to, other types of plastic, rubber, metal, wood, etc. In the present embodiment, each linear track 110 is mounted upon an I-bar frame 120 with end brackets 115 being mounted upon extending arms 125 of frame 120. Frame 120 is preferably made of high-density polyethylene (HDPE) approximately one and one-quarter inch (1¼") in diameter. The total size of the two (2) linear track-hosting frames 120 is approximately twenty-four inches in length by eleven inches in width (24"×11"). Those skilled in the art, in light of the present teachings, will readily recognize that the frames in alternate embodiments may be made of various different materials such as, but not limited to, metal or other types of plastic and may be various different sizes. Linear tracks 110 can be positioned parallel to each other or at various different angles. In the present embodiment, I-bar frames 120 comprise a hinge point 130 that serves as a fulcrum which separates and sets the angle of linear tracks 110. Two rubber feet 127 are attached below each outward-extending arm 125 of I-bar frames 120, totaling eight rubber feet, each of which measures approximately a half-inch in height by a half-inch in diameter (½"×½"). Alternate embodiments may be incorporated with feet made of different materials, more or fewer feet, feet of various different sizes, or feet in various different locations. Yet other alternate embodiments may be incorporated with no feet.

Referring to FIG. 1B, extending from single corners from each I-bar frame 120, and in corresponding alignment to each other, are roundhead arms 135 and 137 of five and three-quarters of an inch length by three and one-half inch width (5¾"×3½"). In alternate embodiments these arms may be various different shapes and sizes. Extending roundhead arm 135 features a centered bolt 140 projecting upward, surrounded by an extended washer 145. Extending roundhead arm 137 features a centered aperture 150, through which bolt 140 of roundhead arm 135 may be inserted to create hinge point 130. A threaded attachment cap 155 is included for attachment upon bolt 140. The configuration of hinge point 130 enables a user to remove attachment cap 155 to separate I-bar frames 120 from each other. Being able to be separated into two pieces enables exercise device 100 to be easily moved and may save money on packaging and shipping. Furthermore, exercise device 100 may come with a carrying case for transporting exercise device 100 from location to location. This enables a user to own one exercise device 100 and use it in multiple locations for example, without limitation, at both home and at work. Those skilled in the art, in light of the present teachings, will readily recognize that the hinge point in alternate embodiments may comprise various types of hinging means such as, but not limited to, a barrel hinge, an arched slot in which rods on the I-bar frames may slide, a simple male/female hook device that connects the two I-bar frames together, a rubberized flexible band, a magnetic attachment, or no hinge point and the user can set the two I-bars in close proximity to one another, etc. In the present embodiment, rubber caps encase each of the three remaining endpoints on each I-bar frame 120; however, in alternate embodiments these caps may be omitted or made of various different materials such as, but not limited to, various types of plastic. In the present embodiment a two-piece stabilizer bar 160 attaches to I-bar frames 120. Each portion of stabilizer bar 160 measures approximately twenty-one inches in length by half-inch diameter (21"×½"); however, the stabilizer bar in alternate embodiments may be larger or smaller. Some alternate embodiments may be incorporated without a stabilizer bar. In the present embodiment, stabilizer bar 160 attaches at points on I-bar frames 120 opposite of extending roundhead arms 135 and 137 and enables I-bar frames 120 to open in an arc pattern while remaining joined at attached extending roundhead arms 135 and 137.

Referring to FIGS. 1C and 1D, padded units 105, made of polyurethane (PU) foam and sealed within a vinyl material, fit on and move upon linear tracks 110 to enable a user to conduct aerobic exercise of the lower extremities. In the present embodiment, padded units 105 are round and of an approximate seven-inch (7") diameter. The center-point depth of padded units 105 is approximately one and one-half inches (1½"), which tapers to a half-inch (½") depth at their perimeters. The rounded design of padded units 105 enables users to maintain good foot contact with padded units 105 regardless of the angle of positioning. For example, without limitation, if exercise device 100 is spread into a wide angle or if it is not spread out at all the feet can still maintain good contact with padded units 105. However, in alternate embodiments, the padded units may be made in various sizes and shapes and may be made of various different materials such as, but not limited to, various plastics, wood, etc. In some embodiments the padded units may comprise straps to hold the feet on the padded units. In some embodiments the padded units may include toe caps that protrude slightly above and slightly over the surface of the padded unit so the user can insert their toes under it to help secure their foot in place. In some embodiments the padded units may include a toe cap and a strap to help maintain the foot in place. In another embodiment this strap and toe cap may rotate around the padded unit in order to maintain foot placement as the splay of the two I-bars change. In the present embodiment, padded units 105 attach upon linear tracks 110 with rotary plane bearing bushings 165 that measure approximately one-inch in length by three-quarters of one inch in width (1"×¾"). Bushings 165 are placed with an approximate three and one-half inch (1½") interior distance between their mountings on the underside of padded units 105. Bushings in alternate embodiments may be larger or smaller and may be positioned on the padded units in various different locations and configurations. Furthermore, in other alternate embodiments, the padded units may be attached to the linear tracks using various different means such as, but not limited to, roller or ball bearings, solid tunnels on the bottom of the padded units, a grooves and channel system could be utilized allowing the padded units to be easily removed and re-applied, a snap on configuration where the padded units snap in place in a semi-permanent configuration, etc.

In typical use of the present embodiment, a user brings exercise device 100 to a location of choice and attaches the separate I-bar frames 120 together at corresponding round-head arms 135 and 137. Exercise device 100 is easy to assemble and requires only two screws. The user may then attach stabilizer bar 160 to I-bar frames 120 and adjust linear tracks 110 to the angle needed to form the foot movement pattern of choice. Once linear tracks 110 are in the desired splay angle, the user tightens attachment cap 155 to hold linear tracks 110 in this position. Referring to FIG. 1D, the user may then sit in any chair and apply his or her feet 170 upon padded units 105. The user then slides feet 170 on padded units 105 back and forth on linear tracks 110 in a pattern of choice indicated by the separating arch between I-bar frames 120. Exercise device 100 enables such aerobic exercise to be conducted in practically any location.

Exercise device 100 provides a convenient means to conduct exercise while in a sitting position, and enables practical exercises to be done by persons who may ordinarily lack opportunity to perform such exercises. Unlike other devices with purposes of allowing exercise while in a sitting position, exercise device 100 does not require any elevation or separation of the knees, thus extending the areas of use of exercise device 100 in comparison to the other devices. Exercise device 100 can be applied upon any floor surface, even upon unlevel surfaces. Since exercise device 100 can easily fit in numerous locations, including, but not limited to, upon the floor area under a desk, in front of a couch, on the floor in front of a passenger seat of a vehicle, in front of wheelchairs, lounge chairs, beside beds, sports benches such as in dugouts, physical therapy benches and chairs, kitchen tables, craft tables, hobby tables, card tables, patio tables, anywhere there is enough room to situate at least one of the I-bars units, etc. This enables busy office workers to conduct practical and therapeutic exercises while working. Exercise device 100 enables persons normally restricted to docile schedules and duties to actively engage in lower extremity exercises which they would ordinarily be unable to perform due to such schedules and duties. Unlike other devices with purposes of allowing exercise while in a sitting position, exercise device 100 is non-resistant, meaning that the user can conduct aerobic exercise with reduced incidences of stress and perspiration, which ordinarily would restrict the areas of use as well as affect the appearance of the user. Exercise device 100 can be used while seated in practically any type of chair and can be easily transported to any area of use. Exercise device 100 operates very quietly with no disturbance to its area of use.

Exercise device 100 also enables persons normally restricted in mobility, such as, but not limited to, users of wheelchairs, to actively engage in lower extremity exercises which they would ordinarily be unable to perform due to such mobility restriction and enables such users to do so without direct assistance from others. Some of the exercises that these users may perform with exercise device 100 include, without limitation, hip, leg, knee, ankle and foot exercises. By enabling such exercises to be performed independently by persons normally restricted in mobility, exercise device 100 also benefits the caregivers and therapists of such persons by allowing the caregivers and therapists to accommodate service to multiple patients and clients simultaneously. By encouraging persons normally restricted in mobility to more actively engage in needed exercise, exercise device 100 can improve the recovery and rehabilitation of such persons and may improve the self-confidence and self-impressions of these users.

In the present embodiment, linear tracks 110 of exercise device 100 can be positioned in vertical alignment to each other, allowing them to fit in restrained areas, such as, but not limited to, under a desk, or linear tracks 110 can be set at various angles to each other. Stabilizer bar 160 secures linear tracks 110 at particular angles. By enabling linear tracks 110 to be set at various angles, exercise device 100 can be used for improvement of particular and defined muscle groups, joints and tendons and can help users achieve individual and specific exercise goals. By helping users achieve individual and specific exercise goals, exercise device 100 is much more personalized than other exercise equipment. By enabling linear tracks 110 to be set at various angles while remaining usable to persons with mobility impairments, exercise device 100 provides exceptional means of exercise of which persons with impaired mobility would ordinarily be completely void.

Exercise device 100 provides means to perform various different types of exercises such as, but not limited to, practical exercises for improvement of the cardiopulmonary system, range of motion exercises, exercised to tone the leg muscles and lower extremities, non-strenuous exercises of the knees, hips, ankles, feet and toes, etc. Exercise device 100 also enables users to perform exercises for specific muscles without the strain, risk of injury or discomfort in these parts of the body, which may be experienced when performing other exercise methods. For example, without limitation, exercise device 100 provides aerobic exercise of the adductors without strain upon or risk of injury to the hips, aerobic exercise of the quadriceps and popliteus without strain upon or risk of injury to the knees, aerobic exercise of the soleus, flexor, anterior and lateral leg muscles without direct impact or resultant discomfort upon the thighs, calves, feet or toes, aerobic exercise of the hamstrings without stress upon or risk of injury to the knees, hips or pelvis, aerobic exercise of the plantaris and tibaelis muscles without stress upon risk of injury to the ankles, etc.

Exercise device 100 helps users burn excess calories in an easy and practical format that enables muscles to use fats for strength and endurance, thus aiding in fat reduction, weight loss and weight management. Furthermore, exercise device 100 can provide other health benefits to its users including, but not limited to, improvement of overall circulation, alleviation of the formation of blood clots, reduction of stress and anxiety in a practical and beneficial format, reduction of the inflammation of varicose veins, telangiectasias and sunburst varicosities as well as reduction of the risk of these conditions, reduction of the risk of osteoporosis, reduction of blood pressure, increase in the count of red blood cells, which will then improve the transport of oxygen throughout the bodies of the users, etc. By increasing red blood cells and improving oxygen transport, exercise device 100 promotes the immune systems of its users and can improve their speed of recovery from injuries and illnesses. By improving the speed of recovery from injuries and illnesses, exercise device 100 can also improve the recovery rate of those using the device for rehabilitation and therapy.

All components of exercise devices according to embodiments of the present invention may be made of various materials and substances of adequate durability and usability. In addition, the entire unit of the exercise device can be made in various sizes, shapes and designs. For example, without limitation, potential alternate embodiments of the present invention are illustrated by way of example in FIGS. 2 and 3 and described in the following description.

Figure 2:
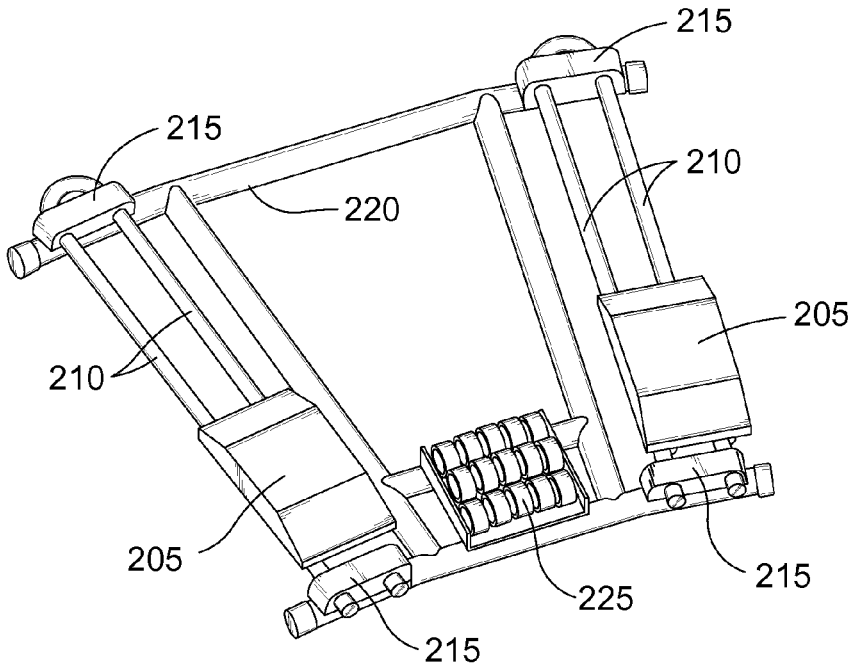
FIG. 2 is a top perspective view of an exemplary exercise device with a static frame, in accordance with an embodiment of the present invention.

FIG. 2 is a top perspective view of an exemplary exercise device 200 with a static frame 220, in accordance with an embodiment of the present invention. In the present embodiment frame 220 is preferably made of mid-gauge steel tubing of two-inch (2") diameter with an overall length of twenty four inches (24"), an overall back width of twenty seven inches (27") and an overall front width of twenty inches (20"); however, the frame may be made of various different materials and may be various different sizes. Linear tracks 210 are attached on top of frame 220 with brackets 215. The static nature of base 220 means that the angle of linear tracks 210 cannot be changed in the present embodiment. Padded units 205 are slidably attached to linear tracks 210. In the present embodiment, padded units 205 are made of foam and sealed within vinyl and measure eight inches by five inches (8"×5") with a sloping top plane. However, padded units of various different shapes, sizes and materials may be used in alternate embodiments of the present invention with a static base.

In the present embodiment, multiple free-rotating discs 225 all in vertical alignment are located on frame 220 at the center of the front of frame 220 for purpose of foot massaging and stimulation. Users can slip off their shoes after exercising to massage their feet upon discs 225. Those skilled in the art, in light of the present teaching, will readily recognize that foot massaging and stimulating means may be included on various other embodiments including, but not limited to, the embodiments illustrated and described in the foregoing an herein. For example, without limitation, free-rotating discs may be located near hinge point 130 of exercise device 100 shown, by way of example, in FIGS. 1A through 1D.

Figure 3:
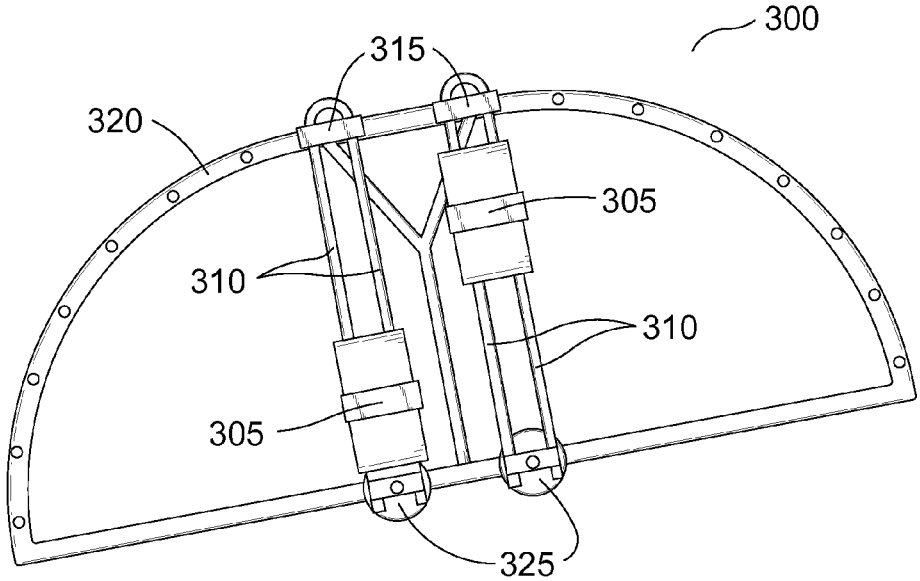
FIG. 3 is a diagrammatic top view of an exemplary exercise device with movable linear tracks, in accordance with an embodiment of the present invention.

FIG. 3 is a diagrammatic top view of an exemplary exercise device 300 with movable linear tracks 310, in accordance with an embodiment of the present invention. In the present embodiment, padded units 305 and linear tracks 310 similar to padded units 205 and linear tracks 210 shown, by way of example, in FIG. 2 are pivotally attached to an arched frame 320 at pivot points 325 and brackets 315. The user may rotate linear tracks 310 about pivot points 325 so that brackets 315 slide along the arched portions of frame 320. Various different means may be used to secure linear tracks 310 once they are in the desired position such as, but not limited to, pins on brackets 315 that are inserted into holes or divots in frame 320, pins on frame 320 that are inserted into holes or divots in brackets 315, clamps, set screws, etc.

In another alternate embodiment, the exercise device may be a motorized, continuous passive motion (CPM) device, in which a motor moves the padded units after a user's feet are securely applied upon the padded units. In this embodiment, the device may have various speed and/or resistance settings, which may be controlled by motors of various sizes. These motors may be powered by alternating current (AC) and/or direct current (DC) sources. This embodiment extends its usability to persons who recently underwent surgical procedures upon the legs, knees, ankles, feet or tendons of these areas, as well as to persons who may lack practical mobility of such limbs, joints and/or tendons.

Alternate embodiments of the present invention may include various features and accessories not described in the foregoing embodiments such as, but not limited to, the following. Some alternate embodiments may include an adjustable friction key upon the padded units to enable the user to increase the resistance and tension required to move the padded units upon their tracks. Some alternate embodiments can be made in which one end may be elevated, at a fixed height or adjustable height, to enable variations of resistance to be applied to the exercises conducted by user of the exercise device. Some alternate embodiments may include electronic accessories commonly used with other exercise devices, such as, but not limited to, a calorie meter, a pedometer, a heart rate monitor, a clock, etc. Some embodiments may include a carrying case to easily accommodate transport to, and subsequent use in, different locations. Some embodiments may bear designs, images or logos, which may or may not be of registered trademark and/or copyright status, upon any location of the device.

Having fully described at least one embodiment of the present invention, other equivalent or alternative methods of providing an exercise device that may be used while seated according to the present invention will be apparent to those skilled in the art. The invention has been described above by way of illustration, and the specific embodiments disclosed are not intended to limit the invention to the particular forms disclosed. For example, the particular implementation of the device may vary depending upon the particular type of tracks used. The tracks described in the foregoing were directed to linear implementations; however, similar techniques are to incorporate tracks with different configurations such as, but not limited to, arcs, circles, etc. Non-linear implementations of the present invention are contemplated as within the scope of the present invention. The invention is thus to cover all modifications, equivalents, and alternatives falling within the spirit and scope of the following claims.

Claim elements and steps herein have been numbered and/or lettered solely as an aid in readability and understanding.

As such, the numbering and lettering in itself is not intended to and should not be taken to indicate the ordering of elements and/or steps in the claims.

What is claimed is:

1. An apparatus for aerobic leg exercise of a seated user, the apparatus comprising:

a first unit comprising:

a first I-bar frame comprising a first bar, extending arms at each distal end of said first bar and a first roundhead arm extending from a first side of said first bar proximate a first distal end of said first bar, said first roundhead arm having a rounded portion at a distal end with an aperture disposed in said rounded portion;

end brackets joined to tops of each extending arm;

a first linear track joined to and disposed between said end brackets; and a first padded unit slidably joined to said first linear track for non-resistive movement between said end brackets, said first padded unit having a generally domed shaped top for enabling the seated user with a multi-positional contact for moving said first padded unit along said first linear track without substantial vertical movement of the seated user's knee; and a second unit comprising:

a second I-bar frame comprising a second bar having a first side generally facing said first roundhead arm, extending arms at each distal end of said second bar and a second roundhead arm extending from said first side of said second bar proximate a first distal end of said second bar, said roundhead arm having a rounded portion at a distal end with a bolt, dimensioned to fit in said aperture, disposed in said rounded portion;

end brackets joined to tops of each extending arm;

a second linear track joined to and disposed between said end brackets; and a second padded unit slidably joined to said second linear track for non-resistive movement between said end brackets, said second padded unit having a generally domed shaped top for enabling the seated user with a multi-positional contact for moving said second padded unit along said second linear track without substantial vertical movement of the seated user's knee.

2. The apparatus as recited in claim 1, wherein said first linear track and said second linear track each comprises at least two linear rods.

3. The apparatus as recited in claim 1, further comprising a plurality of feet joined to bottoms of said extending arms of said first I-bar frame and said second I-bar frame for contacting a floor surface.

4. The apparatus as recited in claim 1, further comprising a threaded attachment cap for securing said first unit and said second unit at a desired splay angle where said bolt is inserted in said aperture and said threaded attachment cap is tightened on said bolt.

5. The apparatus as recited in claim 4, further comprising a stabilizer bar comprising two linear portions rotatably joined at distal ends, said stabilizer bar rotatably joinable to said first I-bar frame and said second I-bar frame.

6. The apparatus as recited in claim 1, wherein dimensions of the apparatus are suitable for placing in an opening under a desk.

7. The apparatus as recited in claim 1, wherein said first padded unit and said second padded unit comprise vinyl covered foam.

8. An apparatus for aerobic leg exercise of a seated user, the apparatus comprising:

a first unit comprising:

a first I-bar frame disposed in a first plane, said first I-bar frame comprising a first bar, extending arms disposed in said first plane at each distal end of said first bar and a first roundhead arm extending along said first plane from a first side of said first bar proximate a first distal end of said first bar, said first roundhead arm having a rounded portion at a distal end with an aperture disposed in said rounded portion;

a plurality of feet joined to bottoms of said extending arms for contacting a floor surface;

end brackets joined to tops of each extending arm portion extending from a second side of said first bar;

a first linear track joined to and disposed between said end brackets, said first linear track comprising at least two linear rods; and a first padded unit slidably joined to said first linear track for non-resistive movement between said end brackets, said first padded unit having a generally domed shaped top for enabling the seated user with a multi-positional contact for moving said first padded unit along said first linear track without substantial vertical movement of the seated user's knee;

a second unit comprising:

a second I-bar frame disposed in said first plane, said second I-bar frame comprising a second bar having a first side generally facing said first roundhead arm, extending arms disposed in said first plane at each distal end of said second bar and a second roundhead arm extending along said first plane from said first side of said second bar proximate a first distal end of said second bar, said roundhead arm having a rounded portion at a distal end with a bolt, dimensioned to fit in said aperture, disposed in said rounded portion;

a plurality of feet joined to bottoms of said extending arms for contacting the floor surface;

end brackets joined to tops of each extending arm;

a second linear track joined to and disposed between said end brackets, said second linear track comprising at least two linear rods; and a second padded unit slidably joined to said second linear track for non-resistive movement between said end brackets, said second padded unit having a generally domed shaped top for enabling the seated user with a multi-positional contact for moving said second padded unit along said second linear track without substantial vertical movement of the seated user's knee;

a threaded attachment cap for securing said first unit and said second unit at a desired splay angle where said bolt is inserted in said aperture and said threaded attachment cap is tightened on said bolt; and a stabilizer bar comprising two linear portions rotatably joined at distal ends, said stabilizer bar rotatably joinable to said first I-bar frame and said second I-bar frame.

9. The apparatus as recited in claim 8, wherein dimensions of the apparatus are suitable for placing in an opening under a desk.

10. The apparatus as recited in claim 8, wherein said first padded unit and said second padded unit comprise vinyl covered foam.

* * * * *